US008323780B1

(12) United States Patent
Simske et al.

(10) Patent No.: US 8,323,780 B1
(45) Date of Patent: Dec. 4, 2012

(54) INK COATINGS FOR IDENTIFYING OBJECTS

(75) Inventors: Steven J. Simske, Fort Collins, CO (US); Lester Ortiz, Camuy, PR (US); Malena Mesarina, San Francisco, CA (US); Vinay Deolalikar, Mountain View, CA (US); Cyril Brignone, Mountain View, CA (US); Guillaume Oget, Santa Clare, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 2127 days.

(21) Appl. No.: 10/961,949

(22) Filed: Oct. 8, 2004

(51) Int. Cl.
*B41M 5/00* (2006.01)

(52) U.S. Cl. ..... 428/195.1; 283/85; 283/87; 283/91; 283/92

(58) Field of Classification Search ..... 428/195.1; 283/85, 91, 92, 89, 87
See application file for complete search history.

(56) References Cited

U.S. PATENT DOCUMENTS

| | | | | |
|---|---|---|---|---|
| 1,167,566 | A * | 1/1916 | Jenkins | 283/94 |
| 3,640,009 | A * | 2/1972 | Komiyama | 283/88 |
| 4,175,775 | A * | 11/1979 | Kruegle | 283/88 |
| 4,455,039 | A | 6/1984 | Weitzen et al. | |
| 4,582,346 | A * | 4/1986 | Caprio et al. | 283/94 |
| 4,604,065 | A * | 8/1986 | Frazer et al. | 434/331 |
| 4,627,819 | A * | 12/1986 | Burrows | 434/337 |
| 4,957,312 | A * | 9/1990 | Morello | 283/89 |
| 5,018,767 | A * | 5/1991 | Wicker | 283/67 |
| 5,169,155 | A * | 12/1992 | Soules et al. | 273/293 |
| 5,193,854 | A * | 3/1993 | Borowski et al. | 283/87 |
| 5,259,907 | A * | 11/1993 | Soules et al. | 156/277 |
| 5,367,148 | A | 11/1994 | Storch et al. | |
| 5,395,137 | A * | 3/1995 | Kim | 283/81 |
| 5,449,202 | A * | 9/1995 | Nalepka et al. | 283/81 |
| 5,522,623 | A * | 6/1996 | Soules et al. | 283/91 |
| 5,583,631 | A | 12/1996 | Lazzerini | |
| 5,636,874 | A * | 6/1997 | Singer | 283/94 |
| 5,766,324 | A * | 6/1998 | Ikegaya et al. | 106/31.15 |
| 5,915,731 | A * | 6/1999 | Jackson | 283/91 |
| 6,203,069 | B1 | 3/2001 | Outwater et al. | |
| 6,207,258 | B1 * | 3/2001 | Varnell | 428/32.1 |
| 6,354,501 | B1 | 3/2002 | Outwater et al. | |
| 6,361,079 | B1 | 3/2002 | Kirkman | |
| 6,396,927 | B1 * | 5/2002 | Phillips | 380/54 |
| 6,663,008 | B1 | 12/2003 | Pettersson et al. | |
| 6,753,952 | B1 | 6/2004 | Lawrence et al. | |
| 2002/0051162 | A1 * | 5/2002 | Kawaguchi et al. | 358/1.12 |

FOREIGN PATENT DOCUMENTS

WO WO 9111331 A1 * 8/1991

OTHER PUBLICATIONS

Petitcolas, Fabien A. P.; Anderson, Ross J.; Kuhn, Markus G., "Information Hiding—A Survey," Proceedings of the IEEE, 87(7): pp. 1062-1078, Jul. 1999.*

Church, Sara E.; Ferguson, Thomas A., "Evaluation of Security Features in New Design U.S. Currency," Proc. of SPIE, vol. 3314: pp. 8-20, Apr. 1, 1998.*

Kauranen, Peter, "The ANOTO pen—Why light scattering matters," ANOTO AB, Lund, Sweden, 2 pages (date unavailable).

* cited by examiner

*Primary Examiner* — Gerard Higgins

(57) ABSTRACT

A coating for an object having identifying indicia disposed thereon. An ink layer contacts at least a portion of the identifying indicia. The ink layer obscures the portion when exposed to light within a predetermined wavelength range, and the ink layer reveals a predetermined area of the portion when exposed to light outside of the predetermined wavelength range.

19 Claims, 4 Drawing Sheets

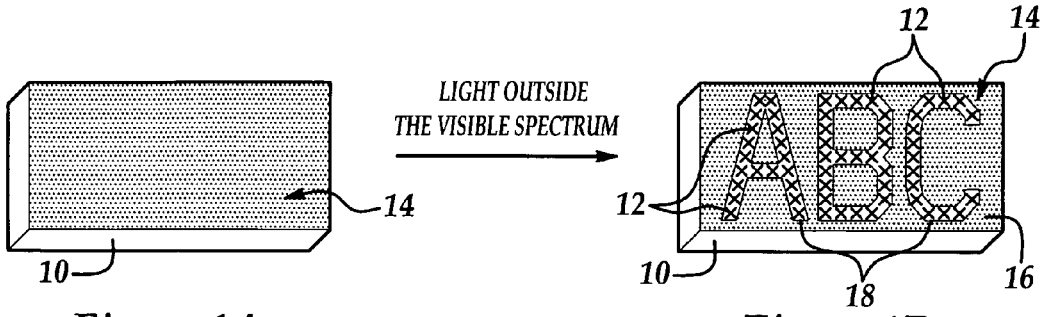
Figure 1A
Figure 1B
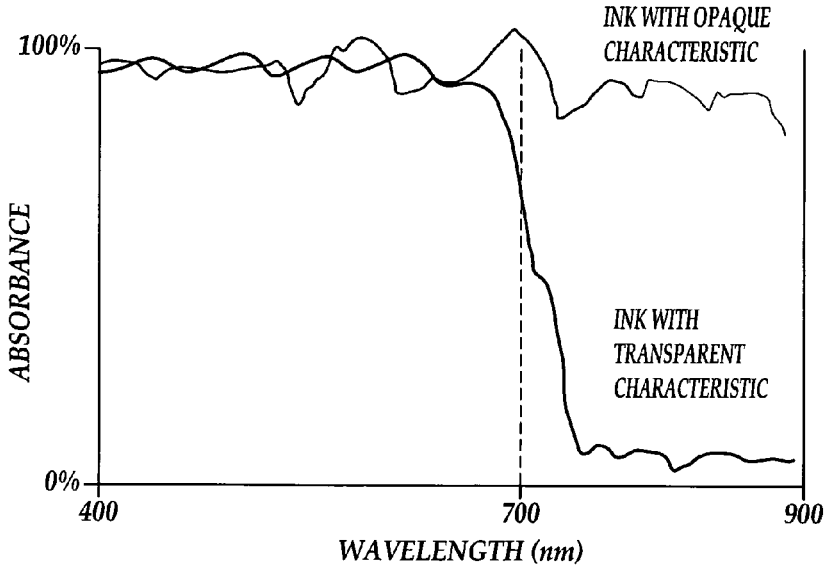
Figure 2
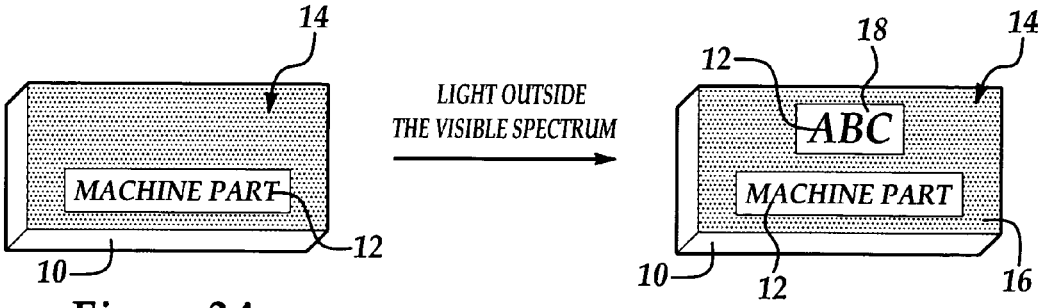
Figure 3A
Figure 3B

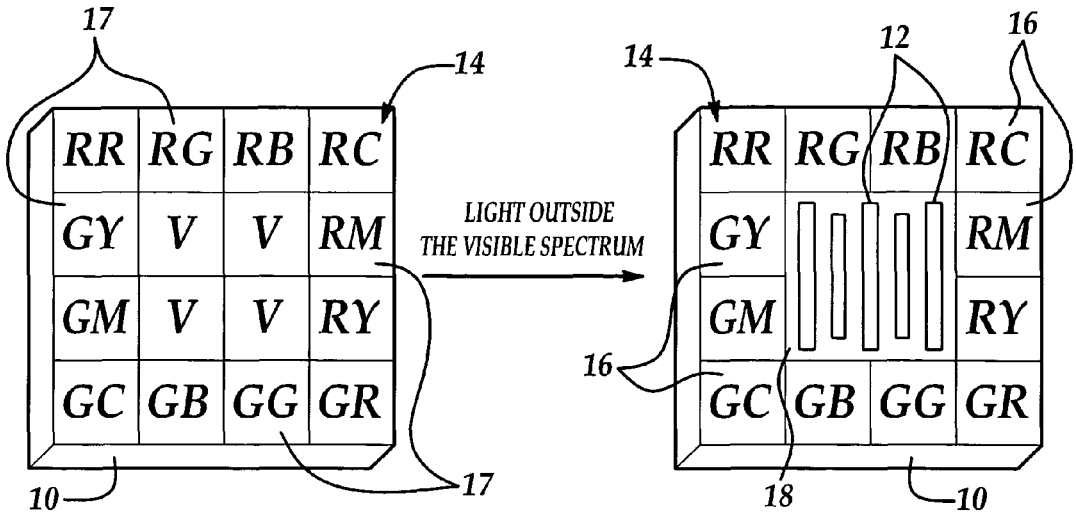
Figure 8A
Figure 8B
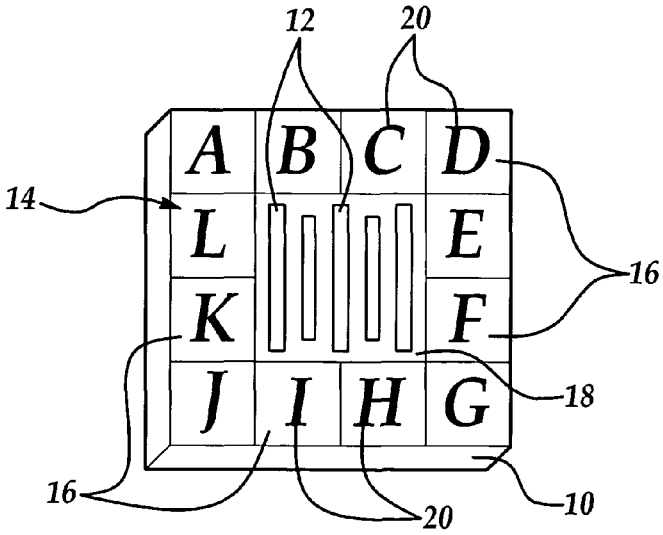
Figure 8C

INK COATINGS FOR IDENTIFYING OBJECTS

BACKGROUND

Embodiments of the present disclosure relate generally to ink coatings and more particularly to ink coatings for identifying objects.

Various objects include serial numbers, bar codes, watermarks, and the like for identifying and/or authenticating such objects. Various techniques for marking objects with these types of identifying marks may, in some instances, not be able to produce the desired mark without substantially destroying the object upon which the mark is placed. Further, current identifying/authenticating techniques may suffer from other drawbacks, some examples of which are as follows. Many current techniques require a separate and/or extra step to provide the authenticating and/or identifying mark(s) in the production of the article and/or package, which may undesirably add to the cost and/or time in producing the article and/or package. Further, in that some current techniques may be relatively static in their placement of identifying/authenticating marks, this may lead to undesirable, facile detection and reproduction of the mark by potential counterfeiters.

Thus, it would be desirable to provide a technique for producing an identifying/authenticating mark without additional steps and without destroying the object upon which the mark is placed. Further it would be desirable to provide a technique that provides an innate moving target for the placement and specific nature of the identifying/authenticating mark.

SUMMARY

A coating for an object having an identifying indicia disposed thereon includes an ink layer contacting at least a portion of the identifying indicia. The ink layer obscures the portion when exposed to light within a predetermined wavelength range, and the ink layer reveals a predetermined area of the portion when exposed to light outside of the predetermined wavelength range.

BRIEF DESCRIPTION OF THE DRAWINGS

Objects, features and advantages will become apparent by reference to the following detailed description and drawings, in which like reference numerals correspond to similar, though not necessarily identical components. For the sake of brevity, reference numerals having a previously described function may not necessarily be described in connection with subsequent drawings in which they appear.

FIGS. 1A and 1B are semi-schematic perspective views of an embodiment of an ink coating in visible light and when exposed to light outside the visible spectrum;

FIG. 2 is a graph depicting the absorbance spectra of inks that are opaque or transparent when exposed to light outside the visible spectrum;

FIGS. 3A and 3B are semi-schematic perspective views of an alternate embodiment of an ink coating in visible light and when exposed to light outside the visible spectrum;

FIGS. 8A, 8B and 8C are semi-schematic perspective views of an alternate embodiment of an ink coating in visible light, when exposed to light outside the visible spectrum, and encrypted corresponding alphanumeric indicia.

DETAILED DESCRIPTION

Figure 4:
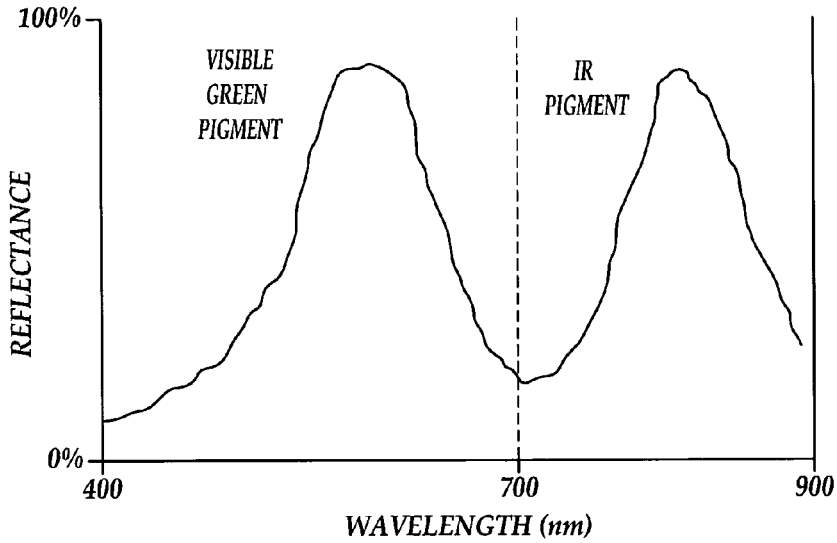
FIG. 4 is a graph depicting the reflectance of an ink layer including both pigment that is visible in visible light and pigment that is visible in IR light.

Embodiments of the present disclosure include an ink layer on an object that may have differential visibility when exposed to predetermined/target light conditions, which advantageously obscures or reveals indicia. The indicia may serve many purposes, non-limitative examples of which include assisting in identifying/authenticating an object, assisting in preventing counterfeiting of the object, and/or the like. Further, embodiment(s) of the present disclosure include the ink layer having differential visibility when exposed to predetermined/target light conditions, which advantageously obscures or reveals a pattern (e.g. an $X^N$ pattern, where X is the range of pattern elements and N is the number of pattern pieces revealed). Still further, embodiments of the present disclosure include an ink layer that encrypts identifying indicia using one or more colors that correspond to alphanumeric and/or graphical characters. Still further, embodiments of the present disclosure include an ink layer having a combination of differential visibility when exposed to predetermined/target light conditions with indicia encrypted using one or more colors corresponding to alphanumeric and/or graphical characters.

It is to be understood that any area of the object that includes the ink layer may convey information in visible light, extra-visible light, and/or in both light domains. Without being bound to any theory, it is believed that this may act as a deterrent for counterfeiting at the data (what is printed, e.g. the pattern of the visible, UV and IR ink pigments) and/or metadata (what the printed information encodes, e.g. ASCII characters, binary sequences, etc.) levels. Further, embodiment(s) of the present disclosure may also provide an innate moving target for the ink layer (for example, allowing the printer to change the {set}, {subset}, and/or relative distribution of the printed data/metadata from one lot/run to the next), thus making counterfeiting substantially difficult.

Some of the Figures described herein depict embodiment(s) of ink layers that reveal/decode and/or obscure indicia/identifying marks outside the presence of visible light. However, it is to be understood that any wavelength range (including, but not limited to the visible light range) may be used for revealing/decoding and/or obscuring such indicia/identifying marks, as described further hereinbelow.

Referring now to FIGS. 1A and 1B together, an embodiment of a coating includes an ink layer 14 established on a surface 11 (shown in FIG. 6C) of an object 10. It is to be understood that any suitable object 10 may be used. In an embodiment, the object 10 includes consumer packaged goods, computers, computer components, printers, print cartridges, paper, packaging materials, toys, games, car and airplane parts, documents (non-limitative examples of which include legal/secure documents), posters, art works (a non-limitative example of which includes giclées), images, videos, images in multi-media/digital entertainment, tickets, brochures, and the like. Specifically, those objects 10 that a user may desire to be identified and/or authenticated at a later date may be desirable for use with embodiment(s) of the present disclosure.

It is to be understood that in any of the embodiments discussed herein, the ink layer 14 may be established on substantially all or a portion of the surface 11 of object 10. According to various embodiment(s) as discussed herein, an indicia 12 may be disposed on and/or in the surface 11 of object 10 prior to the establishment of ink layer 14 on surface 11. The predisposed indicia 12 may be established via any suitable process, including, but not limited to various deposition techniques. Generally, any suitable deposition technique may be used that deposits pigment that responds to light by reflecting, absorbing, and/or fluorescing. Examples of suitable deposition techniques include printing procedures, such as, for example offset printing, flexo printing, gravure printing, dry electrophotography (DEP), laser printing, liquid electrophotography (LEP), thermal, acoustic, and piezoelectric inkjet printing, continuous inkjet printing, laser and contact thermal printing, combinations thereof, and the like. When predisposed indicia 12 is so placed, the ink layer 14 may contact/overlay some and/or all of the predisposed indicia 12.

In an alternate embodiment, the indicia 12 and the ink layer 14 are established on the object 10. The ink layer 14 may be engraved such that, upon exposure to light outside a predetermined wavelength range, the predisposed indicia 12 and/or portions thereof is revealed. It is to be understood, however, that in light within the predetermined wavelength range (e.g. the visible spectrum), the ink layer 14 and indicia 12 may appear to be substantially the same or different color. Further, it is to be understood that engraving the ink layer 14 is not limited to this example and may be used in combination with the various embodiments disclosed herein.

In the embodiment shown in FIGS. 1A and 1B (as well as in the remaining Figures except FIGS. 2, 4, 7A and 7B), the ink layer 14 forms a first section including an amount of a transparent ink 18, and a second section including an amount of an opaque ink 16. Without being bound to any theory, it is believed that these inks 16, 18 give the ink layer 14 its differential visibility when exposed to light within a target wavelength bandwidth. While the opaque ink 16 and the transparent ink 18, respectively, exhibit opaque and transparent qualities when exposed to light outside the predetermined wavelength range, it is to be understood that both inks 16, 18 are adapted to obscure the indicia/portion thereof 12 when exposed to light within the predetermined wavelength range, such that neither the presence nor the content of the indicia/portion thereof 12 are visible within the predetermined wavelength range.

It is to be understood that the predetermined wavelength range may include any wavelength ranges (e.g., the visible spectrum, the IR spectrum, the UV spectrum, etc.). In a non-limitative example (as depicted in some of the Figures, including FIGS. 1A and 1B), the predetermined wavelength range is the visible spectrum. In this example, the opaque and transparent qualities of the ink layer 14 are visible when exposed to some or all of the wavelengths outside the visible spectrum (i.e. the wavelengths above about 700 nm (e.g. up to about $10^2$ m) and the wavelengths below about 400 nm (e.g. as low as $10^{-16}$ m)), while the ink layer 14 obscures the indicia/portion thereof 12 when exposed to the visible spectrum.

In an embodiment, the indicia/portion thereof 12 may be static and pre-printed on the object 10. The (overlying) design of the ink layer 14 may determine the pattern of the indicia/portion thereof 12 that is visible when exposed to light outside the predetermined wavelength range. For example, in a non-limitative embodiment, the indicia/portion thereof 12 is partially obscured by the ink layer 14 when exposed to light outside the predetermined wavelength range.

FIG. 2 depicts the absorbance spectra of two non-limitative example inks. The absorbance in the visible wavelength range (400 nm-700 nm) indicates that the inks are substantially identical when exposed to visible light. The absorbance in the IR range (700 nm-900 nm) indicates that one of the inks exhibits opaque characteristics while the other exhibits transparent characteristics when exposed to IR light.

It is to be understood that the inks 16, 18 forming the second and first sections, respectively, may be established on the object 10 in any shape, configuration, and/or geometry as desired. In an embodiment, the first and second sections are substantially contiguous; while in an alternate embodiment, the first and second sections are substantially non-contiguous. In the non-limitative example depicted in FIG. 1B, the inks 16, 18 are deposited such that when exposed to light outside the predetermined wavelength range, transparent ink 18 appears transparent, and the predisposed indicia 12 (for example, "ABC") is revealed.

The opaque ink 16 remains opaque when exposed to light outside the predetermined wavelength range. In an embodiment, the opaque ink 16 of the ink layer 14 contains a material (s) that reflects and/or absorbs light when it is exposed to visible light (between about 400 nm and about 700 nm), ultraviolet light (between about 190 nm and about 400 nm), and infrared light (between about 700 and about 1100 nm).

In an embodiment, the opaque ink 16 includes an extant ink with visible light properties having predetermined (depending upon the desired spectral property) pigments/dyes that absorb and/or reflect wavelengths outside the visible spectrum (e.g. the UV and/or IR range) mixed therein. It is to be understood that the pigments/dyes are present in an effective amount in the extant ink(s). Some nonlimitative examples of opaque ink 16 include inks containing carbon, process black ink, and/or mixtures thereof.

As previously indicated, the transparent ink 18 exhibits its transparent characteristic when exposed to certain light conditions, a non-limitative example of which is light outside of the visible spectrum. As used herein, it is to be understood that the terms "transparent" or "substantially transparent" inks are meant to include inks which sufficiently allow the underlying object 10 and/or predisposed indicia 12 to appear through the transparent ink 18 upon exposure to predetermined light conditions/wavelength range(s). In an embodiment, the transparent ink 18 is formed from a material(s) that transmits light when exposed to wavelength(s) below about 400 nm and wavelength(s) above about 700 nm (non-limitative examples of which include ultraviolet light (between about 190 nm and about 400 nm) and/or infrared light (between about 700 nm and about 1100 nm)). Some non-limitative examples of transparent inks 18 include a non-carbon containing black ink, inks that include an effective amount of predetermined (depending upon the desired spectral property) IR visible and/or UV visible dyes/pigments therein, inks that have had IR absorbent/reflective and/or UV absorbent/reflective dyes/pigments removed therefrom, and mixtures thereof. Generally, the transparent ink 18 is established such that, upon exposure to light outside the predetermined wavelength range, a predetermined area of the object 10 and/or a predetermined area of the predisposed indicia 12 that may be present on the object 10 is revealed.

Therefore, it is to be understood that in one embodiment, the transparent ink 18 contacts the predisposed indicia 12, while the opaque ink 16 contacts some or all of the surface 11 of object 10.

In an alternate embodiment (not shown in the figures), the ink layer 14 is formed from transparent ink 18 such that the entire area beneath the ink layer 14 (whether the surface 11 of object 10 and/or the predisposed indicia 12) is revealed upon exposure to light outside the predetermined wavelength range.

Exposing the object 10 to light outside the predetermined wavelength range may be accomplished by any suitable means. Non-limitative examples of such means include ultraviolet lamps, infrared lamps, scanning digital devices, pens, flashlights, digital cameras, and the like.

Referring now to FIGS. 3A and 3B, one portion of the predisposed indicia 12 has transparent ink 18 established thereon, while the remaining portion(s) of the predisposed indicia 12 are left visible in visible light. In this embodiment, the portion of the predisposed indicia 12 left visible may act as, for example, a source or product identifier for the public, while the portion of the predisposed indicia 12 obscured by the transparent ink 18 (when in visible light) of the ink layer 14 may identify the object's authenticity and/or identity when the predisposed indicia 12 is revealed.

As previously indicated, it is to be understood that the predisposed indicia 12 may act as an authentication tool. Non-limitative examples of suitable predisposed indicia 12 in relation to the various embodiment(s) as disclosed herein include, but are not limited to, alphanumeric indicia (as shown in FIG. 1B), graphical indicia (as shown in FIGS. 8B and 8C), one or more colors, and/or combinations thereof. The predisposed indicia 12 is made of a material (a non-limitative example of which includes any pigmented or spectrally-dependent reflective material, such as, for example, IR and/or UV visible inks) that reflects and/or absorbs at least one of visible light, ultraviolet light, infrared light, and combinations thereof.

In an embodiment, inks used for the predisposed indicia 12 that reflect ultraviolet light may include organic and/or inorganic down-converting phosphors which are invisible in visible light. These down-converting phosphors, when excited by UV radiation, convert the UV radiation into visible light or other detectable wavelengths, thus allowing the predisposed indicia 12 to be seen. In an alternate embodiment, inks used for the predisposed indicia 12 that reflect infrared light may include organic and/or inorganic up-converting phosphors. These up-converting phosphors, when excited by IR radiation, convert the infrared radiation into visible light or other detectable wavelengths, thus allowing the predisposed indicia 12 to be seen. One non-limitative example of such an IR ink is commercially available from LDP Net located in Woodcliff Lake, N.J. under the designation "IR1 Ink". This ink fluoresces at 840 nm and has a peak stimulation (absorption) frequency of 793 nm. In a non-limitative example, the indicia 12 may be formed with the IR1 ink and the ink layer 14 may be used to differentially block the indicia 12. In order to differentially block the indicia 12, the ink layer 14 may include pigment(s) that may absorb or reflect IR light but do not fluoresce at substantially the same wavelength as the IR1 ink, as well as pigments that absorb or reflect visible light.

The inks 16, 18 in the ink layer 14 may be substantially the same color, different colors, or they may be a combination of substantially the same and different colors in the predetermined wavelength range (e.g. the visible spectrum). In an embodiment, the colors used may be those that are substantially difficult to reproduce, such as, for example, saturated greens, blues, and reds. Ink layer 14, though it may include both one or more transparent ink 18 section(s) and/or one or more opaque ink 16 section(s), may appear to be a smooth, uniform (though not necessarily single color) coating on the object surface 11. Further, one or more layers of the inks 16, 18 may be deposited to form the ink layer 14. The following table depicts examples of suitable sublayers and their respective visibility in various light ranges. It is to be understood that "Anti-Transp." or anti-transparent inks are inks that can be seen under any light (e.g. IR or UV) except visible light.

| | Upper Opaque | Upper Transp. | Lower | Upper Anti-Transp. |
|---|---|---|---|---|
| Absorbent to Visible | Yes | Yes | Yes | No |
| Absorbent to IR | Yes | No | Yes | Yes |

As a non-limitative example, the ink layer 14 may include a lower layer that is opaque (absorbent to both visible and IR light) and an upper layer having two portions, one that is visible in visible light and transparent in IR light and the other that is opaque. In this embodiment, the lower opaque layer may act as the identifying/authenticating mark as its presence is covered by the upper layer until exposure to IR light. Upon exposure to IR light, the portion of the upper layer that is transparent in IR light reveals the lower layer. In this non-limitative example, generally the opaque layers or portions of the layers may be different colors such that a pattern is revealed upon exposure to IR light. It is to be understood that any suitable combination of layers may be used in accordance with the present disclosure.

In one embodiment, the ink layer 14 may include a mixture of and/or layers of an ink/pigment that is visible when exposed to light within the predetermined wavelength range and an ink/pigment that is visible when exposed to light outside the predetermined wavelength range. FIG. 4 depicts the reflectance of a green ink layer 14 that includes both green ink/pigment that is visible in visible light and green ink/pigment that is visible in IR light. In this embodiment, a Visible/IR over-patterning feature is available in addition to the previously described pre-deposited indicia 12 plus ink layer 14 approach. This feature allows for a different, complementary IR pattern in the ink layer 14 also. As such, substantially the same and/or similar final variability is achievable with a static indicia 12 as with indicia 12 which is non-static (e.g. is deposited in different positions and/or orientations on object 10).

It is to be understood that the ink layer 14 thickness may generally be dependent on several factors, including the print technology used. In an embodiment, the thickness of the ink layer 14 ranges between about 1 micron and about 100 microns.

It is to be understood that when the ink layer 14 is being established, generally the inks 16, 18 are established substantially simultaneously or substantially sequentially. Examples of suitable techniques used to establish the ink 16, 18 include, but are not limited to deposition techniques, such as for example, drop-on-demand ink jetting techniques (e.g. thermal, piezo, acoustic and the like), continuous ink jetting techniques, other printing procedures, such as, for example offset printing, flexo printing, gravure printing, dry electrophotography (DEP), laser printing, liquid electrophotography (LEP), thermal printing (e.g. laser, contact, etc.), combinations thereof, and the like.

For the various embodiment(s) described hereinabove and hereinbelow, it is to be understood that the selected deposition technique may alter the effect of bleed/interaction between the sections of the ink layer 14, multiple ink layers 14, and/or any preprinted indicia 12. Generally, inkjet printing substantially controls pigment bleed by the droplet size and water evaporation. In an embodiment, the size of the indicia 12 and/or ink layer 14 is visible (or becomes visible in non-visible light) to the human eye, and thus bleed has substantially little effect on the readability of the mark.

Further, in multi-pass printing techniques, the first layer (e.g. the indicia 12 or a sublayer of ink layer 14) is substantially dry prior to the deposition of the second layer (e.g. ink layer 14 or another sublayer of ink layer 14). It is to be understood that drying times may vary between deposition techniques.

In the embodiment(s) of the ink layer 14 that include sublayers with substantially precise alignment of the multiple layers (i.e. registration), a liquid electrophotography technique may be selected. Without being bound to any theory, it is believed that this technique provides substantially precise alignment of up to about sixteen layers of ink (including inks overlapping each other) without drying concerns. Furthermore, this technique allows for variability between print jobs. Other printing techniques may be selected for a multiple sublayer ink layer 14, however, it is to be understood that additional coatings between the sublayers may be advantageous for print processes that "penetrate," such as, for example inkjet with paper.

Figure 5A:
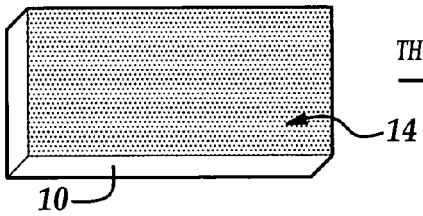
FIGS. 5A and 5B are semi-schematic perspective views of a further alternate embodiment of an ink coating in visible light and when exposed to light outside the visible spectrum.
Figure 5B:
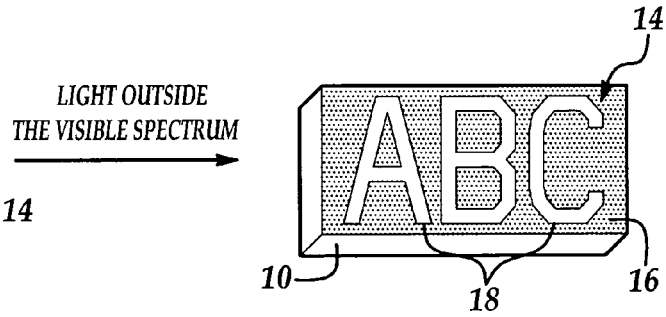

Referring now to FIGS. 5A and 5B, an alternate embodiment is depicted. The ink layer 14, including both the opaque ink 16 and the transparent ink 18, obscures the underlying object 10 when exposed to the predetermined wavelength range (e.g. visible light in FIG. 5A) and reveals some or all of the underlying object 10 when exposed to light outside the predetermined wavelength range (FIG. 5B). In this embodiment however, the object 10 does not contain a previously established predisposed indicia 12 thereon. Rather, the inks 16, 18 themselves form an image, mark and/or identifying indicia.

As depicted, the inks 16, 18 are established on the object 10 such that when the transparent ink 18 exhibits its transparency in predetermined light conditions, the image, mark and/or identifying indicia (a non-limitative example of which is the alphanumeric "ABC") is revealed by the contrast between the opaque ink 16 and the transparent ink 18.

Figure 6A:
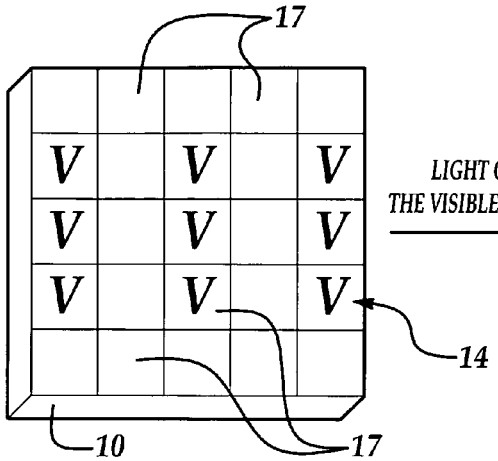
FIGS. 6A and 6B are semi-schematic perspective views of yet a further alternate embodiment of an ink coating in visible light and when exposed to light outside the visible spectrum.
Figure 6B:
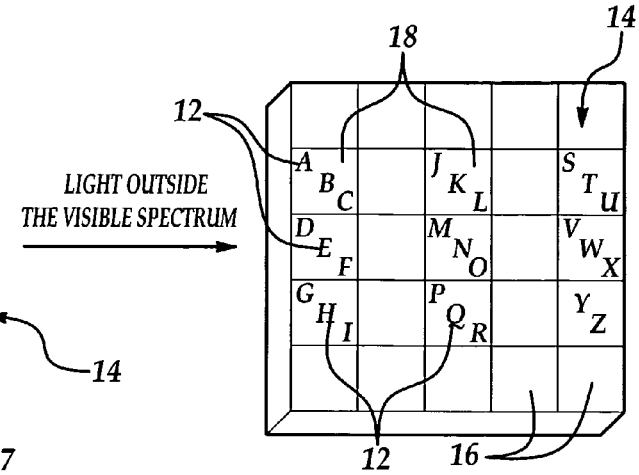
Figure 6C:
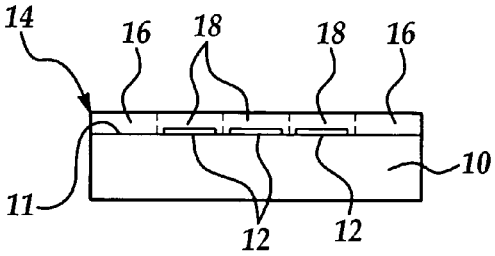
FIG. 6C is a semi-schematic left side view of the embodiment depicted in FIG. 6B.

FIGS. 6A through 6C depict an embodiment that is similar to that depicted in FIGS. 1A and 1B. However, the object 10 and/or a portion of the object 10 may be divided into cells 17 each having a predetermined area. It is to be understood that the predetermined area of the cells 17 depends upon several factors, including but not limited to the modulation transfer function (MTF) of the scanning device, which depends on the charge-coupled device (CCD), lens, etc. Some non-limitative examples include about 1/80" (for most current technology scanners, including low-cost scanners), about 1/40" (for most current technology cameras), and about 1/20" (for most current technology phone cameras). However, it is to be understood that these examples are illustrative, as these predetermined areas is subject to change as the relevant technology advances.

In one embodiment, each of the cells has a predetermined area of 1/40 inch×1/40 inch. In this embodiment, one square inch of the object 10 contains 1,600 cells 17 upon which the ink layer 14 may be established. Each cell 17 may also be given an x,y coordinate used to identify the particular cell 17 when establishing the predisposed indicia 12 (if used) and/or the ink layer 14. It is to be understood that the cell subdivisions may or may not be visible, and/or may or may not be directly in contact with the object 10 (e.g. the subdivisions may be on a mask or template), but are shown in FIGS. 3A and 3B for illustrative purposes. It is to be understood that the cells 17 may form a "checkerboard like pattern," that is a "grid pattern" or a "Cartesian target pattern" with the colored ink, which makes M×N patterns. It is to be further understood that the cells 17 may take on or form other shapes or geometries as desired.

In an embodiment, a colored ink "checkerboard" pattern may also be disposed under an ink layer 14. In this embodiment, the ink layer 14 may also be disposed in the checkerboard pattern. It is to be understood that the ink layer 14 may include the various colors or may appear to be a single uniform color when exposed to light in the predetermined wavelength range. The ink layer 14 may include pigments/inks that are variably opaque and transparent when exposed to light outside the predetermined wavelength range, such that portion(s) or substantially all of the underlying checkerboard pattern is revealed. Thus, the underlying checkerboard layer provides a pattern for the deposition of the ink layer 14.

As depicted in FIG. 6A, the ink layer 14 is formed in a pattern that is visible, for example to the naked eye, in visible light. In this non-limitative example, the "V" pattern may be deposited in one color and the remaining blank cells may be deposited in a different color(s). The pattern shown in this figure is for illustrative purposes, and it is contemplated that, in one embodiment, the inks 16, 18 of the ink layer 14 may be established in any suitable pattern that is visible to the naked eye.

FIG. 6B depicts the object 10 after exposure to light outside the visible spectrum. The predisposed indicia 12 (in this example alphanumeric) that underlies the transparent ink 18 section(s) of the ink layer 14 are revealed. In this example, the "blank" cells 17 have opaque ink 16 established thereon.

FIG. 6C illustrates a view of FIG. 6B from the left side of the object 10. As depicted, the predisposed indicia 12 are established on the surface 11 of object 10, and the ink layer 14 includes sections of both the opaque ink 16 and sections of the transparent ink 18.

Figure 7A:
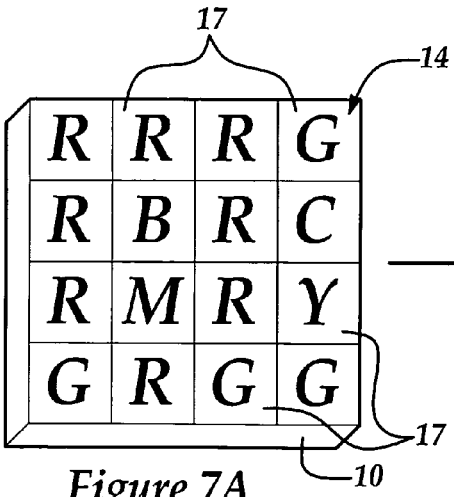
FIGS. 7A and 7B are semi-schematic perspective views of an embodiment of an ink coating and an illustration of encrypted corresponding alphanumeric indicia.
Figure 7B:
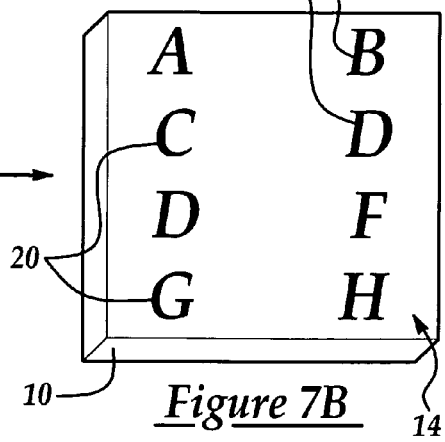

Referring now to FIGS. 7A and 7B, an embodiment of ink layer 14 includes a plurality of colors, denoted by the various letters. In this embodiment, the ink layer 14 may include transparent ink 18, opaque ink 16, and/or combinations thereof. It is to be understood that the colors of the ink layer 14 may be fully overt in visible light. The colors used in the ink layer 14 may themselves advantageously be used for identifying, authenticating, and/or tracking the object 10. The number of color combinations available and the possibility of linking other data on the object 10 with the colors allows for variability from object 10 to object 10, thus providing overt features on the object 10 for tracking and/or identifying/authenticating.

In one non-limitative example, one square inch of an object 10 may contain 1,600 1/40 inch×1/40 inch cells 17. Using six encoding colors: red (R), green (G), blue (B), cyan (C), magenta (M), and yellow (Y), 800 alphanumeric characters may be encoded in the one square inch. It is to be understood that the number of alphanumeric characters encrypted in a pair of cells 17 may depend in part on the number of colors used, the size of the cell 17, the number of alphanumeric characters used in the code, and the like. If eight colors are used, for example, (RGBCMYKW) then up to sixty-four alphanumeric characters (non-limitative examples of which include twenty-six uppercase and/or lowercase letters, ten digits, and two special characters) may be encrypted in a pair of cells 17. In another non-limitative example, if six colors are used (RGBCMY), then thirty-six characters may be used. It is to be understood that the colors may also correspond to graphical characters, or any other variable marking schemes, in addition to and/or as a substitution for alphanumeric characters.

The following is a non-limitative example of an alphanumeric mapping system that corresponds to color combinations using six colors—RGBCMY.

| Color Combination | Corresponding Alphanumeric Character |
|---|---|
| RR | A |
| RG | B |
| RB | C |
| RC | D |
| RM | E |
| RY | F |
| GR | G |
| GG | H |
| GB | I |
| GC | J |
| GM | K |
| GY | L |
| BR | M |
| BG | N |
| BB | O |
| BC | P |
| BM | Q |
| BY | R |
| CR | S |
| CG | T |
| CB | U |
| CC | V |
| CM | W |
| CY | X |
| MR | Y |
| MG | Z |
| MB | 0 |
| MC | 1 |
| MM | 2 |
| MY | 3 |
| YR | 4 |
| YG | 5 |
| YB | 6 |
| YC | 7 |
| YM | 8 |
| YY | 9 |

It is to be further understood that the number of characters encrypted in a pair of cells 17 may also depend on the instrument being used. In a non-limitative example, a high resolution scanner may be capable of detecting (substantially error-free) authenticating marks disposed at 200×200 per square inch of the object 10, resulting in 40,000 cells 17, or 20,000 characters per square inch using the 36-alphanumeric-to-six colors scheme. In another, non-limitative example, a camera phone may be able to detect (substantially error-free) authenticating marks at 20×20 per square inch of the object 10, resulting in 200 characters per square inch for the same scheme. It is to be understood that embodiment(s) of the present disclosure may misregister an image during capture by fractions of pixels, or a few pixels, but still advantageously accomplishes substantially error-free reading and verification/authentication of the targets.

In FIG. 7A, the ink layer 14 is depicted as a 4×4 checkerboard-like pattern of colors established on the object 10. It is to be understood that the colors of the ink layer 14 may be established in the cells 17 in a substantially random and/or substantially uniform pattern. In this example embodiment, each pair of colors in the ink layer 14 corresponds to an alphanumeric character (as shown above in the example mapping system) that allows a user to determine or decode the "hidden" or "encrypted" indicia 20 within the ink layer 14. In this non-limitative example, the pair "RR" corresponds to the letter "A", and "RG" corresponds to the letter "B", etc. A user may determine the color combination for a pair of cells 17 in the ink layer 14, determine the corresponding alphanumeric and/or graphical characters, and decrypt the encrypted indicia 20. It is to be understood that the pair of cells 17 may be a horizontal, vertical, or diagonal pair as determined by a user encoding the object 10 when establishing the plurality of colors.

FIG. 7B depicts the encrypted indicia 20 on the object 10. It is to be understood that in this embodiment, the encrypted indicia 20 is not actually "visible" (because it is encrypted) in any light, visible spectrum or non-visible spectrum. Therefore, FIG. 7B is for illustrative purposes. As described herein, the hidden/encrypted indicia 20 may be decrypted by knowing which color(s) corresponds to which alphanumeric and/or graphical character(s).

It is to be understood that this hidden/encrypted indicia 20 may be used in combination with other embodiment(s) disclosed herein (see e.g. FIGS. 1B, 5B, and 6B) such that the hidden indicia 20 acts as an additional or second (identifying/authenticating) indicia 20.

FIGS. 8A through 8C illustrate an embodiment of the object 10 having an ink layer 14 that includes both the predisposed indicia 12 beneath the ink layer 14 and a hidden indicia 20 within the ink layer 14. FIG. 8A depicts an ink layer 14 having various colors (denoted by the double letters, e.g. "RR") and an area in the center that is substantially the same color (denoted by the "V"). The ink layer 14 in this embodiment has a somewhat random and somewhat uniform visible pattern.

FIG. 8B illustrates the object 10 having ink layer 14 thereon when exposed to light outside the predetermined wavelength range. In this non-limitative embodiment, the ink layer 14 contains transparent ink 18 in the center and opaque ink 16 along the edges. As illustrated, upon exposure to light outside the predetermined wavelength range, the transparent ink 18 reveals the predisposed indicia 12 that is established on the object 10. In this embodiment, the predisposed indicia 12 is a graphical indicia.

In this embodiment, the opaque ink 16 contributes to forming the visible pattern, but it also contains an encrypted (second) indicia 20 based on the color combinations used. A similar alphanumeric mapping system that is described above may be used to "decode" the hidden indicia 20. FIG. 8C illustrates what the object 10 would look like if the hidden indicia 20 were visible and if the ink layer 12 were exposed to light outside the predetermined wavelength range to reveal the predisposed indicia 12. As stated previously, the encrypted indicia 20 (decoded using an alphanumeric or graphical mapping system as described herein) is not actually visible in any light, visible or non-visible. Therefore, FIG. 8C is for illustrative purposes. As described herein, the hidden or encrypted indicia 20 may be revealed by knowing which color(s) corresponds to which alphanumeric or graphical character(s).

Further, the colors used in the ink layer 14 (that are seen in visible light) may act as an overt identifying/authenticating feature. A certain color combination, alone or in addition to being linked to other data on and/or associated with the object 10, may assist in identifying/authenticating the object 10. In an embodiment, the colors may be part or all of an overt branding or logo located on the object 10, such that it would not be obvious that the object 10 also contains encrypted information. It is to be understood that while the colors of the ink layer 14 may provide visible patterns for tracking and tracing or branding, the predisposed indicia 12 under the ink layer 14 or the position of the opaque and transparent inks 16, 18 may be variable.

In the embodiment(s) disclosed herein, encoded/encrypted/hidden data may be incorporated in and/or under the ink layer 14. It is to be understood that this data may substantially match some other identifying feature on the object 10, such as, for example, a bar code number, a serial number, an SKU/product number, a lot number, and the like.

Embodiment(s) of the present disclosure offer many advantages, some non-limitative examples of which follow. An embodiment of the ink layer 14 may have differential visibility, which advantageously obscures or reveals predisposed indicia 12 which may assist in verifying the identity and/or authenticity of an object. The ink layer 14 itself may also form an identifying indicia when exposed to light outside a predetermined wavelength range (e.g. non-visible light if the predetermined wavelength range is visible light). Further, embodiments of the ink layer 14 may form identifying hidden indicia 20 with various color combinations that correspond to alphanumeric and/or graphical characters. Still further, embodiments of the present disclosure combine layer(s) 14 having differential visibility with layer(s) 14 having color and corresponding alphanumeric/graphical characters to provide various levels for verifying the identity and/or authenticity of an object. It is to be understood that the ink layer(s) 14 disclosed herein may also advantageously aid in preventing counterfeiting of the objects 10. Still further, the ink layer 14 may be deposited as part of an existing printing process, thus substantially eliminating additional authenticating devices and/or manufacturing steps for adding the identifying/authenticating features.

While several embodiments have been described in detail, it will be apparent to those skilled in the art that the disclosed embodiments may be modified. Therefore, the foregoing description is to be considered exemplary rather than limiting.

What is claimed is:

1. An object, comprising:

an identifying indicia disposed on the object, the identifying indicia including an ink, having pigments therein, that is opaque when exposed to light both inside and outside a predetermined wavelength range;

an ink layer established on at least one portion of the identifying indicia and obscuring the at least one portion of the identifying indicia when exposed to light within the predetermined wavelength range;

wherein the ink layer includes:

a first section including a first section ink that obscures the at least one portion of the identifying indicia when exposed to the light within the predetermined wavelength range, but is substantially transparent and thus reveals the at least one portion of the identifying indicia when exposed to light outside the predetermined wavelength range; and a second section including a second section ink that is opaque when exposed to the light both within and outside the predetermined wavelength range;

wherein the second section ink is coated in relation to the at least one portion of the identifying indicia so that the second section ink is visible and opaque but does not obscure the at least one portion of the identifying indicia when the ink layer is exposed to the light outside the predetermined wavelength range.

2. The object as defined in claim 1 wherein the first section is contiguous with the second section.

3. The object as defined in claim 1 wherein the first section ink includes a material which transmits light when exposed to at least one of a wavelength above about 700 nm or a wavelength below about 400 nm, and wherein the second section ink includes a material that at least one of reflects light or absorbs light when exposed to at least one of a wavelength above about 700 nm or a wavelength below about 400 nm.

4. The object as defined in claim 1 wherein the predetermined wavelength range comprises the visible spectrum and wherein the first section ink is substantially transparent when exposed to the light outside the visible spectrum.

5. The object as defined in claim 1 wherein the ink of the identifying indicia comprises a material that at least one of reflects and absorbs at least one of visible light, ultraviolet light, infrared light, or combinations thereof.

6. The object as defined in claim 1 wherein the identifying indicia is at least one of alphanumeric indicia, graphical indicia, color indicia, or combinations thereof.

7. The object as defined in claim 1 wherein the ink layer has a thickness ranging between about 1 micron and about 100 microns.

8. The object as defined in claim 1 wherein the ink layer comprises a plurality of colors, and wherein each of the plurality of colors corresponds to at least one of an alphanumeric character or a graphical character, the ink layer thereby providing a second identifying indicia.

9. An object, comprising:

a surface;

an indicia in contact with the surface, the indicia including an ink, having pigments therein, that is opaque when exposed to light both inside and outside a predetermined wavelength range; and an ink layer established on at least one portion of the indicia and obscuring the portion of the indicia when exposed to light within the predetermined wavelength range, the ink layer including:

a first section including a first section ink that obscures the at least one portion of the indicia when exposed to the light within the predetermined wavelength range, but is substantially transparent and thus reveals the at least one portion of the indicia when exposed to light outside the predetermined wavelength range; and a second section including a second section ink that is opaque when exposed to the light both inside and outside the predetermined wavelength range;

wherein the second section ink is coated in relation to the at least one portion of the indicia so that the second section ink is substantially opaque and visible but does not obscure the at least one portion of the indicia when exposed to the light outside the predetermined wavelength range.

10. The object as defined in claim 9 wherein the object is selected from consumer packaged goods, computers, computer components, printers, print cartridges, paper, packaging materials, toys, games, car and airplane parts, documents, posters, art works, images, videos, images in multi-media entertainment, images in digital entertainment, tickets, brochures, or combinations thereof.

11. The object as defined in claim 9 wherein the predetermined wavelength range comprises the visible spectrum and wherein the first section ink is substantially transparent when exposed to the light outside the visible spectrum; and the second section ink is opaque when exposed to the light outside the visible spectrum.

12. The object as defined in claim 11 wherein the first section ink and the second section ink are substantially the same color in the visible spectrum.

13. The object as defined in claim 11 wherein the first section ink includes a material that transmits light when exposed to at least one of a wavelength above about 700 nm or a wavelength below about 400 nm and wherein the second section ink includes a material that at least one of reflects or absorbs light when exposed to at least one of a wavelength above about 700 nm or a wavelength below about 400 nm.

14. The object as defined in claim 11 wherein the first section ink and the second section ink are different colors.

15. The object as defined in claim 9 wherein the indicia is at least one of alphanumeric indicia, graphical indicia, color indicia, or combinations thereof.

16. The object as defined in claim 9 wherein the ink of the indicia comprises a material that at least one of reflects or absorbs at least one of visible light, ultraviolet light, infrared light, or combinations thereof.

17. The object as defined in claim 9 wherein the ink layer comprises a plurality of colors, and wherein each of the plurality of colors corresponds to at least one of an alphanumeric character and a graphical character, the ink layer thereby providing a second indicia.

18. An object, comprising:

an identifying indicia established on the object, the identifying indicia including an ink, having pigments therein, that is opaque when exposed to light both inside and outside a predetermined wavelength range; and an ink layer established on at least a portion of a surface of the object and on the identifying indicia, the ink layer comprising a plurality of colors, each of the plurality of colors corresponding to at least one of alphanumeric characters or graphical characters, the ink layer thereby providing an encrypted indicia when exposed to light within a predetermined wavelength range;

wherein the ink layer includes:

a first section including a first section ink established on the identifying indicia, the first section ink being opaque when exposed to the light within the predetermined wavelength range and substantially transparent when exposed to light outside the predetermined wavelength range; and a second section including a second section ink established on the object, the second section ink being opaque when exposed to the light both inside and outside the predetermined wavelength range, the first section ink revealing the identifying indicia when exposed to light outside the predetermined wavelength range.

19. The object as defined in claim 18 wherein the ink layer contacts about one square inch of the object, wherein the plurality of colors includes six colors, and wherein the number of alphanumeric characters ranges in number between about 200 and about 20,000.

* * * * *